US007246468B2

(12) United States Patent
Forbis, Sr. et al.

(10) Patent No.: US 7,246,468 B2
(45) Date of Patent: Jul. 24, 2007

(54) SHADE ASSEMBLY FOR STORAGE TANK AND METHOD OF USE THEREOF

(76) Inventors: Jack R. Forbis, Sr., 283 Sundown Dr., Waco, TX (US) 76712; Ann R. Forbis, 283 Sundown Dr., Waco, TX (US) 76712

( * ) Notice: Subject to any disclaimer, the term of this patent is extended or adjusted under 35 U.S.C. 154(b) by 0 days.

(21) Appl. No.: 10/394,129

(22) Filed: Mar. 21, 2003

(65) Prior Publication Data

US 2003/0177704 A1 Sep. 25, 2003

Related U.S. Application Data

(60) Provisional application No. 60/366,225, filed on Mar. 21, 2002.

(51) Int. Cl.
*B62D 63/04* (2006.01)

(52) U.S. Cl. ..... 52/3; 52/192; 135/96; 220/200

(58) Field of Classification Search ..... 52/3, 52/23, 5, 4, 63, 582.11, 192, DIG. 12, 2.25, 52/173.1; 135/96; 220/200, 212, 287, 315; 150/154

See application file for complete search history.

(56) References Cited

U.S. PATENT DOCUMENTS

| | | | | |
|---|---|---|---|---|
| 1,720,232 A | | 7/1929 | North | |
| 2,688,822 A | | 9/1954 | King | 47/28 |
| 2,889,664 A | | 6/1959 | Olshansky | 47/28 |
| 2,974,442 A | | 3/1961 | Womelsdorf | 47/26 |
| 3,315,727 A | | 4/1967 | Clark | 160/84 |
| 3,476,032 A | | 11/1969 | Mattly | 98/2 |
| 3,788,542 A | | 1/1974 | Mee | 239/2 R |
| 3,862,876 A | * | 1/1975 | Graves | 428/83 |
| 3,863,694 A | * | 2/1975 | Fisher | 220/565 |
| 3,902,290 A | | 9/1975 | Marquet | 52/249 |
| 3,949,527 A | * | 4/1976 | Double et al. | 52/4 |
| 3,990,532 A | | 11/1976 | Robinson | 180/115 |
| 4,020,826 A | | 5/1977 | Mole | 126/270 |
| 4,020,827 A | | 5/1977 | Broberg | 126/271 |
| 4,068,404 A | | 1/1978 | Sheldon | 47/26 |
| 4,194,319 A | | 3/1980 | Crawford | 47/27 |

(Continued)

FOREIGN PATENT DOCUMENTS

DE 20018360 U1 3/2002

(Continued)

OTHER PUBLICATIONS

PCT International Search Report PCT/US03/08962. 8 pages.

(Continued)

*Primary Examiner*—Kimberly Wood
(74) *Attorney, Agent, or Firm*—Dunlap Codding & Rogers, P.C.

(57) ABSTRACT

A shade panel assembly that covers the top and sides of a storage tank. Such assemblies might also include a water dispensation system to dispense water mist substantially in the area of the shade assembly in the region between the assembly and the tank or substantially onto the shade panels. The panel assembly, when in an operative position over a storage tank, serves as a pollution control technology and, as such, may qualify for such environmental incentives.

24 Claims, 2 Drawing Sheets

U.S. PATENT DOCUMENTS

| | | | | | |
|---|---|---|---|---|---|
| 4,391,865 | A | | 7/1983 | Constance | 428/74 |
| 4,433,700 | A | * | 2/1984 | Dohet | 135/97 |
| 4,498,262 | A | | 2/1985 | Garcia | 52/173 |
| 4,562,675 | A | | 1/1986 | Baigas, Jr. et al. | 52/202 |
| 4,730,423 | A | | 3/1988 | Hughes | 52/173 R |
| 4,732,012 | A | | 3/1988 | Thorpe | 62/304 |
| 4,763,440 | A | | 8/1988 | James | 47/2 |
| 5,083,396 | A | | 1/1992 | Traut | 47/28.1 |
| 5,193,714 | A | * | 3/1993 | Carey | 220/592 |
| 5,365,703 | A | | 11/1994 | Zeidler | 52/62 |
| 5,400,848 | A | | 3/1995 | Gainer | 160/238 |
| 5,423,150 | A | | 6/1995 | Hitchcock | 52/1 |
| 5,497,633 | A | | 3/1996 | Jones et al. | 62/314 |
| 5,502,929 | A | | 4/1996 | Daniels | 52/69 |
| 5,505,788 | A | | 4/1996 | Dinwoodie | 136/246 |
| 5,522,184 | A | * | 6/1996 | Oviedo-Reyes | 52/23 |
| 5,548,933 | A | * | 8/1996 | Sharma et al. | 52/192 |
| 5,562,155 | A | | 10/1996 | Blumberg et al. | 165/128 |
| 5,579,794 | A | * | 12/1996 | Sporta | 135/88.01 |
| 5,598,719 | A | | 2/1997 | Jones et al. | 62/304 |
| 5,605,007 | A | | 2/1997 | Hinsperger | 47/17 |
| 5,699,785 | A | | 12/1997 | Sparkman | 126/623 |
| 5,752,617 | A | * | 5/1998 | Yung | 220/571 |
| 5,791,090 | A | * | 8/1998 | Gitlin et al. | 52/4 |
| 5,860,251 | A | * | 1/1999 | Gleich | 52/2.25 |
| 5,884,709 | A | * | 3/1999 | Evans et al. | 169/46 |
| 5,966,877 | A | * | 10/1999 | Hawes | 52/63 |
| 6,009,891 | A | * | 1/2000 | Surface et al. | 135/98 |
| 6,061,977 | A | | 5/2000 | Toyama et al. | 52/173.3 |
| 6,063,996 | A | | 5/2000 | Takada et al. | 136/246 |
| 6,158,175 | A | * | 12/2000 | Carter | 52/79.5 |
| 6,161,362 | A | * | 12/2000 | Forbis et al. | 52/745.06 |
| 6,170,281 | B1 | * | 1/2001 | Barnett | 62/259.1 |
| 6,176,050 | B1 | * | 1/2001 | Gower | 52/222 |
| 6,886,299 | B2 | * | 5/2005 | Gower | 52/222 |
| 2003/0337558 | | | 2/2003 | Torres et al. | 62/259.1 |
| 2003/0177703 | A1 | * | 9/2003 | Forbis et al. | 52/3 |
| 2003/0177705 | A1 | | 9/2003 | Forbis, Sr. et al. | 52/3 |

FOREIGN PATENT DOCUMENTS

| | | |
|---|---|---|
| EP | 0911201 A2 | 4/1999 |
| EP | 0911201 A3 | 9/2001 |
| WO | 95/16100 | 6/1995 |

OTHER PUBLICATIONS

International PCT Search Report PCT/US03/08961, 9 pages, Mailed Jul. 15, 2003.

International PCT Search Report PCT/US03/08962, 8 pages, Mailed Jul. 9, 2003.

International PCT Search Report PCT/US03/08869, 8 pages, Mailed Jul. 8, 2003.

"Average Electricity Emission Factors by State and Region", Energy Information Administration, *Updated State-and Regional-level Greenhouse Gas Emission Factors for Electricity,* www.eia.doe.gov/pub/oiaf/1605/cdrom/pdf/e-supdoc.pdf, pp. 1-3, Mar. 2002.

"Banks say Tackle Climate Change or Face the Consequences", Edie News, printed from www.greenbiz.com/news/printer.cfm?NewsID=22643, pp. 1-2, Oct. 14, 2002.

"Building Concrete Solutions", Logix Insulated Concrete Forms, 9 pages, No date.

"Control of Air Pollution from Volatile Organic Compounds", Chapter 115 of Texas Natural Resource Conservation Commission Rule Log No. 1998-089-101-A1, pp. 1-7, No Date.

"Cooler Buildings Clear our Skies and Cut Costs", Brochure by CoolTexasBuildings.net, No date.

"Does your energy bill have you seeing red?", Brochure by Cool Roof Systems, Inc., No date.

"Energy Conservation in the Home", SECO Fact Sheet No. 9, pp. 1-4, No date.

"Energy Efficiency in Science & Technology Facilities", Technically Speaking, Carter & Burgess, Jun. 2002.

"Environmental Pollutants from Electricity Production", SECO Fact Sheet No. 25, pp. 1-4, No date.

"Heat from the Sun", SECO Fact Sheet No. 5, pp. 1-4, No date.

"Heat Stress Management. Portable Cooling for Workers . . . ", ThermalDyn™, Advertised in American Industrial, vol. 3, issue 2, No date.

"High Albedo (Cool) Roofs", Codes and Standards Enhancement (CASE) Study, Pacific Gas and Electric Company, pp. 1-20, Nov. 17, 2000.

Linking Energy Efficiency and Air Quality: Energy Efficiency and Renewable Energy in the NOx Budget Trading Program, www.epa.gov/appdstar/state_local_govnt/state_outreach/, pp. 1-4, Printed Mar. 10, 2003.

"Making the Business Case for High Performance Green Buildings", U.S. Green Building Council, 14 pages, No date.

"Passive Solar Design for the Home", SECO Fact Sheet No. 17, pp. 1-4, No date.

"Rainwater Collection System with Several Options", City of Austin, Figures, pp. 1-4, No date.

"Rollshutters, most effective", Rollshutter Company of Waco, Inc., Advertised in *WACOAN, Waco's City Magazine* p. 68, No date.

"Roofing in a Greener World", www.buildings.com, pp. 1-5, Oct. 2002.

"Solar Electricity Works for Texas", SECO Fact Sheet No. 12, pp. 1-4, No date.

"Sustainable by Design. How Energy-Efficient, Ecologically Friendly Design is Shaping Today's Buildings", Technically Speaking, Carter & Burgess, May 2003.

"Top 10 Reasons You Need Rollshutters for Your Home or Business", Rollshutter Company of Waco, Inc., *Waco Today,* one page, Oct. 2003.

"Upgrade Now to Hail Resistant Metal Roofing by Mueller", Mueller Inc., Advertised in *The Lone Star Iconoclast,* p. 1, May 28, 2003.

Akbari, et al., "Implementation of Heat Island Reduction Measures: Where We Are and Where We Need to Go", Energy and Environmental Policy, §9.1-9.13, Presented at ACEEE Summer Study, Pacific Grove, California, 2002.

Barkaszi, Jr. et al., "Florida Exterior Wall Insulation Field Test: Final Report", www.fsec.ucf.edu/bldg/pubs/cr868/index.htm, pp. 1-15, Dec. 1995.

Dietsch, et al., "Emphasizing the Co-Benefits of Heat Island Mitigation: Lessons from U.S. Local Governments Engaged in Climate Protection", Energy and Environmental Policy, §9.71-9.82, Presented at ACEEE Summer Study, Pacific Grove, California, 2002.

Fixed Roof Storage Tank Calculation Spreadsheet from study on AP-42, Draft, 5 pages, No date.

http://eetd.lbl.gov/HeatIsland/CoolRoofs/HeatTransfer/, pp. 1-3, Printed Oct. 20, 2003.

http://eetd.lbl.gov/HeatIsland/CoolRoofs/HeatTransfer/Emittance.html, pp. 1-2, Printed Oct. 20, 2003.

http://eetd.lbl.gov/HeatIsland/CoolRoofs/HeatTransfer/heating.html, pp. 1-2, Printed Oct. 20, 2003.

http://eetd.lbl.gov/HeatIsland/CoolRoofs/Instruments/, pp. 1-3, Printed Oct. 20, 2003.

http://eetd.lbl.gov/HeatIsland/CoolRoofs/Samples.html, pp. 1-3, Printed Oct. 20, 2003.

Huang, et al., "The Energy Performance of a Combined Roof Mist Shading System", DOE-2 Computer Simulations—Forbis Shadecover Technology, 9 pages, Oct. 2001.

Kinzey, et al., "The Federal Buildings Research and Development Program: A Sharp Tool for Climate Policy", Energy and Environmental Policy, §9.219-229, No date.

Koch-Nielson, Holger, "Stay Cool: A Design Guide for the Built Environment in Hot Climates", Chapters 4-6, 2002.

Parker, Danny, "Cool Roofs for Hot Climates", Journal of Light Construction, pp. 75-81, Jun. 2003.

Parker, et al., "Comparative Summer Attic Thermal Performance of Six Roof Constructions", www.fsec.ucf.edu/bldg/pubs/pf337/index.htm, pp. 1-11, Printed Oct. 17, 2003.

Parker, et al., "Demonstration of Cooling Savings of Light Colored Roof Surfacing in Florida Commercial Buildings: Our Savior's School", www.fsec.ucf.edu/bldg/pubs/cr904/index.htm, pp. 1-16, Jun. 1996.
Parker, et al., "Demonstration of Cooling Savings of Light Colored Roof Surfacing in Florida Commercial Buildings: Retail Strip Mall", www.fsec.ucf.edu/bldg/pubs/cr964/index.htm, pp. 1-20, Oct. 1997.
Parker, et al., "Laboratory Testing of the Reflectance Properties of Roofing Materials", www.fsec.ucf.edu/bldg/pubs/cr670/index.htm, pp. 1-13, Jul. 2000.
Parker, et al., "Measured Cooling Energy Savings from Reflective Roofing Systems in Florida: Field and Laboratory Research Results", www.fsec.ucf.edu/bldg/pubs/pf293/index.htm, pp. 1-23, Printed Oct. 17, 2003.
Photograph of Covered Entry, Waco, TX, Photographed Jun. 2003.
Photograph of Covered Walkways, Educator's Credit Union, Waco, TX, Photographed Sep. 2003.
Photograph of Equipment Screen and Awnings and Canopy, Fuddrucker's Restaurant, Waco, TX, Photographed Sep. 2003.
Photograph of Equipment Screen, Allen Samuels Auto Group Headquarters, Photographed Sep. 2003.
Photograph of Equipment Screen, Boys and Girls Club, Tulsa, OK, Photographed Sep. 2003.
Photograph of Equipment Screen, Scott & White Clinic, Waco, TX, Photographed Sep. 2003.
Photograph of Equipment Screens and Natural Shade, Waco TX, Photographed Sep. 2003.
Photograph of Natural Shade and Awning, Waco, TX, Phtotographed Sep. 2003.
Photograph of Natural Shade, Austin, TX, Photographed Jul. 2003.
Photograph of Natural Shade, MCC Building, Austin, TX, Photographed Jul. 2003.
Photograph of Overhang Patio with Misters and Awnings, On the Border Restaurant, Waco, TX, Photographed Sep. 2003.
Photograph of Overhang, Waco, TX, Photographed Sep. 2003.
Photograph of Parking Lot Cover, Genie's Car Wash, Waco, TX, Photographed Jun. 2003.
Photograph of Playground Cover, Austin, TX, Photographed Jul. 2003.
Pomerantz, M., et al., "The Effect of Pavements' Temperatures on Air Temperatures in Large Cities", Heat Island Group, pp. 1-20, Apr. 2000.
Rosenfeld, et al., "Painting the White—and Green", MIT's Technology Review, pp. 1-10, Feb./Mar. 2000.
UniRac, Inc., "SolarMount™", Advertised in *Solar Today,* p. 69, May/Jun. 2003.
Wong, et al., "Opportunities to Advance Heat Island Mitigation Policy", Energy and Environmental Policy, §9.395-9.406, Presented at ACEEE Summer Study, Pacific Grove, California, 2002.
Wong, Eva, "The U.S. Environmental Protection Agency's Heat Island Reduction Initiative (HIRI): Status and Future Directions", U.S. Environmental Protection Agency, pp. 1-11, No date.
www.consumerenergycenter.org/homeandwork/homes/inside/windows/shades.html, "Shades and Awnings", pp. 1-3., Printed Oct. 17, 2003.
www.coolroofs.org/pdf/productlisting_1003.pdf, Cool Roof Rating Council Product Listing, pp. 1-13. Oct. 7, 2003.
www.dfwinfo.com/energy/energybro.pdf, Brochure from North Central Texas Council of Governments Department of Environmental Resources, pp. 1-2, No date.
www.eere.energy.gov/erec/factsheets/coolhome.html, Consumer Energy Information: Fact Sheets, pp. 1-9, No date.
www.epa.gov/tri/tridata/tri00/state/Texas.pdf, "2000 Toxics Release Inventory, Texas", pp. 1-4, 2000.
www.epa.gov/ttn/chief/ap42/ch07/final/c07s01.pdf, "Liquid Storage Tanks", §7.1-1 to 7.1-101. Environmental Protection Agency, Sep. 1997.
www.epa.gov/oar/oagps/takingtoxics/sum4.html, "Taking Toxics Out of the Air", pp. 1-6, Printed Jan. 16, 2003.
www.fsec.ucf.edu/bldg/commercial/walls-roofs/index.html, "Walls and Roofs", pp. 1-2, Printed Oct. 17, 2003.
www.greenbuilder.com/sourcebook/roofing.html, Green Building Program, Sustainable Building Sourcebook (Roofing), pp. 1-9, Printed Oct. 17, 2003.
www.msnbc.com/news/791658.asp, "Survival plan for 'urban heat islands", pp. 1-9, Aug. 14, 2002.
www.pak-unlimited.com/html/products/accessories/hardware/hardware.htm, Pak Unlimited, Inc., Accessories-Cable & Rope, 3 pages, Printed Jan. 11, 2003.
www.shadeco.net/main.htm, ShadeCo Structures, pp. 1-6, Printed Oct. 24, 2003.
www.shadesails.com/, Shade Sails LLC, pp. 1-4, Printed Oct. 17, 2003.
www.shade-sails.com/, Shade Sails LLC, pp. 1-4, Printed Oct. 17, 2003.
www.shadesails.com/custom%20made1.htm, Shade Sails LLC, pp. 1-2, Printed Oct. 17, 2003.
www.shadesails.com/eating.htm, Shade Sails LLC, pp. 1-3, Printed Oct. 17, 2003.
www.shadesails.com/entryway.htm, Shade Sails LLC, pp. 1-2, Printed Oct. 17, 2003.
www.shadesails.com/hardware.htm, Shade Sails LLC, pp. 1-7, Printed Oct. 17, 2003.
www.shadesails.com/mall.htm, Shade Sails LLC, pp. 1-5, Printed Oct. 17, 2003.
www.shadesails.com/new_page_1.htm, Shade Sails LLC, pp. 1-2, Printed Oct. 17, 2003.
www.shadesails.com/newpage3.htm, Shade Sails LLC, one page, Printed Oct. 17, 2003.
www.shadesails.com/public.htm, Shade Sails LLC, pp. 1-2, Printed Oct. 17, 2003.
www.shadesails.com/ready%20made.htm, Shade Sails LLC, pp. 1-7, Printed Oct. 17, 2003.
www.storm-hurricane-shutters.com, "ShutterPro Window Shutters", ShutterPro Hurrican Shutter Inc., one page, Printed Oct. 17, 2003.
www.sunports.com/advertising/files/brochure%2003.pdf, SunPorts Intenational LLC, pp. 1-6, Printed Oct. 20, 2003.
www.sunports.com/advertising/files/walkways_combo%203.pdf, SunPorts International LLC, pp. 1-3, Printed Oct. 20, 2003.
www.unirac.com/pdfs/ds_sm.pdf, "SolarMount™· PV Module Mounting System", UniRac, Inc, Printed Oct. 17, 2003.
Pat Walsh; Improving Petroleum Product Storage; Farm*A*Syst Fact Sheet Mar. 6, 2000; pp. 1-8; University of Nebraska Cooperative Extension EC 98-762-S; Nebraska.
Ministry of Agriculture and Food; Farm Storage and Handling of Petroleum Products; Farm Mechanization Fact Sheet; Nov. 1994; pp. 1-4; Order No. 210.510-1; British Columbia, Canada.
Jeffrey H. Siegell's "Exploring VOC Control Options," Chemical Engineering Jun. 1996, 5 Pages.

* cited by examiner

SHADE ASSEMBLY FOR STORAGE TANK AND METHOD OF USE THEREOF

PRIORITY CLAIM

The present application claims priority under 35 U.S.C. §119(e) to U.S. Provisional Patent Application Ser. No. 60/366,225 filed Mar. 21, 2002.

TECHNICAL FIELD OF THE INVENTION

The present invention relates to a shade assembly for cooling, or prevaporization solar heating of, a storage tank and a method of using such an assembly. The shade assembly of the present invention provides a unique option that certain industries will find helpful in their pollution control efforts, particularly in the area of volatile organic compound emission reductions, thus the present invention serves as a pollution control technology.

BACKGROUND OF THE INVENTION

Many types and sizes of storage tanks are widely used by industrial and manufacturing enterprises to hold chemicals, fuels and other commercial products. There are above-ground and underground tanks, and various regulations put in place by national and state-level environmental agencies apply to storage tanks. In regard to above-ground storage tanks, when located outdoors in warmer climates, they may absorb substantial amounts of solar radiation. Tanks may also be located on rail cars and trucks and form the major portion of tanker ships. All such storage tanks may suffer from the heating effects of solar radiation.

When tanks are located in full sunlight, as they often must be, and the sun's heat causes them to reach certain temperatures, the surface temperature of the stored substance also becomes warmer and some of the product being stored can evaporate or "vaporize". The longer the sun strikes the tank, the more it heats not only the tank's exterior, but also its interior contents. When vaporization occurs, air pollution results unless the vapors are captured and sent to a control device. Seals of different types have been designed for floating roof storage tanks to help minimize evaporative losses. Various vapor recovery and treatment systems have been developed in order to reduce the amount of volatile organic compound (VOC) releases to the atmosphere as well as treatment measures for the releases of other types of pollutants such as nitrogen oxides (NOx).

Many of the currently available technologies for pollution control are complex, expensive and may also involve the release of certain pollutants in the course of their operation. The present invention provides a prevention-based, cost-effective solution that releases no emissions of its own and is projected to be helpful in reducing VOC emissions of certain types of stored substances from various types and sizes of tanks. The types of tanks may include fixed roof tanks, external floating roof tanks, internal floating roof tanks, domed roof tanks, as well as storage tanks for propane and LPG that may be cylindrical, "bullet" tanks and spherical tanks. Drawings and descriptions of some commonly used tank types and seals can be found in a chapter on Liquid Storage Tanks at http://www.epa.gov/ttn/cheif/ap42/ch07/final/c07s01.pdf, accessed Mar. 20, 2003.

Toxic emissions may be discharged from such petrochemical storage tanks when increased levels of solar radiation and ambient air temperature induce substantial heating of the tanks and their contents. Keeping an inventory of toxic emission releases to the environment, and working to reduce such toxic releases, has brought about significant improvements in environmental quality over the years. In a U.S. Environmental Protection Agency (EPA) document entitled "Taking Toxics Out of the Air" at http://www.epa.gov/oar/oaqps/takingtoxics/sum4.html, (accessed Jan. 16, 2003), various measures and rules are discussed that are intended to reduce toxic emissions. One section, "Oil and Natural Gas Production and Natural Gas Transmission and Storage" relates that "Emissions of air toxics from oil and natural gas production and natural gas transmission and storage occur during separation, upgrade, transport, and storage of crude oil, condensate, natural gas, and related products." Releases from oil and natural gas facilities, the report continues, may include benzene (a known human carcinogen) and other VOCs that are "suspected to cause cancer or other serious health effects".

From the same report, VOCs' role in ground level ozone (smog) creation is discussed briefly, and the EPA announced the expected benefits to air quality projected to result from the rule changes. Those rules required "controls for the following emission points at oil and natural gas production facilities: process vents at some glycol dehydration units, tanks with flashing emission potential, and some fugitive emission sources. Natural gas transmission and storage facilities will be required to control emissions from process vents at some glycol dehydration units."

EPA gathers and maintains information on toxic releases by industrial sources in each state; such information regarding releases, both on-site and off-site to the air, land and water, are available for various years at http://www.epa.gov/tri/tridata, accessed Mar. 20, 2003. It is therefore of high importance to strive to limit or eliminate releases to the environment of substances that may be harmful to humans and wildlife. Pollution control technologies are developed and brought to market so they may play a key role in this effort. The shade panel assembly of the present invention can be instrumental in air quality improvement, not only at a particular industrial plant, but also across a wide area through which it has been put into use. This is due to its VOC-reduction potential which, in turn, will help lower the amount of ground-level ozone formation thereby providing public health benefits during the summer months (the "ozone season") and economic benefits for the company whose stored product (that previously has been lost through vaporization) is not lost to the atmosphere but can be used or sold instead.

The primary cause of this temperature related vaporization loss is the presence or absence of direct sunlight. The longer the sun strikes the tank, the more it heats not only the tank but also its contents such as oil, gasoline and a host of other chemicals. As the temperature of the exterior surfaces or "skin temperature" of the tank increases, it causes the liquids within the tank to expand and evaporate, converting some of the liquid to vapor form. If this expansion is drastic enough, it will cause the tank to release some of the vapors into the atmosphere to prevent the tank from over-pressurizing and rupturing. This not only causes air pollution but also wastes natural resources as stated above, vaporization reduces the amount of product that can be sold, thereby reducing profits. On large tank farms, and in the warmest areas of the country/world, this loss of product and resulting pollution caused by temperature fluctuations over an extended period of time is quite substantial.

Accordingly, the need exists for new technologies to prevent heating of storage tanks or reduce VOC emissions from those tanks.

SUMMARY OF THE INVENTION

The invention includes a shade system and assembly for a storage tank. The assembly may include any structure and/or covering designed to cover all or a portion of a storage tank, particularly a petrochemical storage tank, which reduces solar heating of the tank. The assembly may be made of a scaffold sized to surround the storage tank and installed in an operative position. The scaffold may then be covered with shade panels. Alternatively, the scaffold may be attached to and extend laterally from the top of the storage tank. Shade panels may be attached to the top of the scaffold in an operative position to cover the top of the storage tank. Additional shade panels may attach to the rim of said scaffold in an operative position to cover the sides of the storage tank. These side panels may also be attached to ground anchors.

The assembly may also include a water dispensation system to dispense water substantially onto the shade panels or in the region between the panels and the tank. This system may be accompanied by a water collection system and/or a control mechanism. Dark shade panels may be used in combination with a water dispensation system.

The invention also includes another type of shade assembly for a storage tank wherein the shade panels are attached to the top of a storage tank and to ground anchors in an operative position to cover the sides of the storage tank. These shade panels may extend at an angle from the top of the tank to the ground. The top of the tank may be covered with a top assembly made of an array of blocks placed around the top rim of the storage tank and at least one shade panel attached to the blocks in an operative position to cover the top of the tank. Reflective shade panels may be used with this embodiment.

The invention additionally includes a method of cooling or preventing solar heating of a storage tank by providing a shade assembly in an operative position to cover the sides and/or top of said tank.

In another example, the shade assembly may be a movable or retractable shade system. In one embodiment, this system may follow the sun's movement automatically.

The shade assembly of the present invention may be constructed of various methods and by various designs which may allow the finished shade assembly over the storage tank to resemble any geometric shape (that is or has been normally utilized in the construction industry) and that may be desired in order to meet aesthetic as well as durability and functionality requirements.

For a better understanding of the invention and its advantages, reference may be made to the following description of exemplary embodiments and accompanying drawings.

DETAILED DESCRIPTION OF THE INVENTION

Exemplary embodiments of the present invention and their advantages are best understood by reference to FIGS. 1 through 5, where like numbers are used to indicate like and corresponding features.

Figure 1:
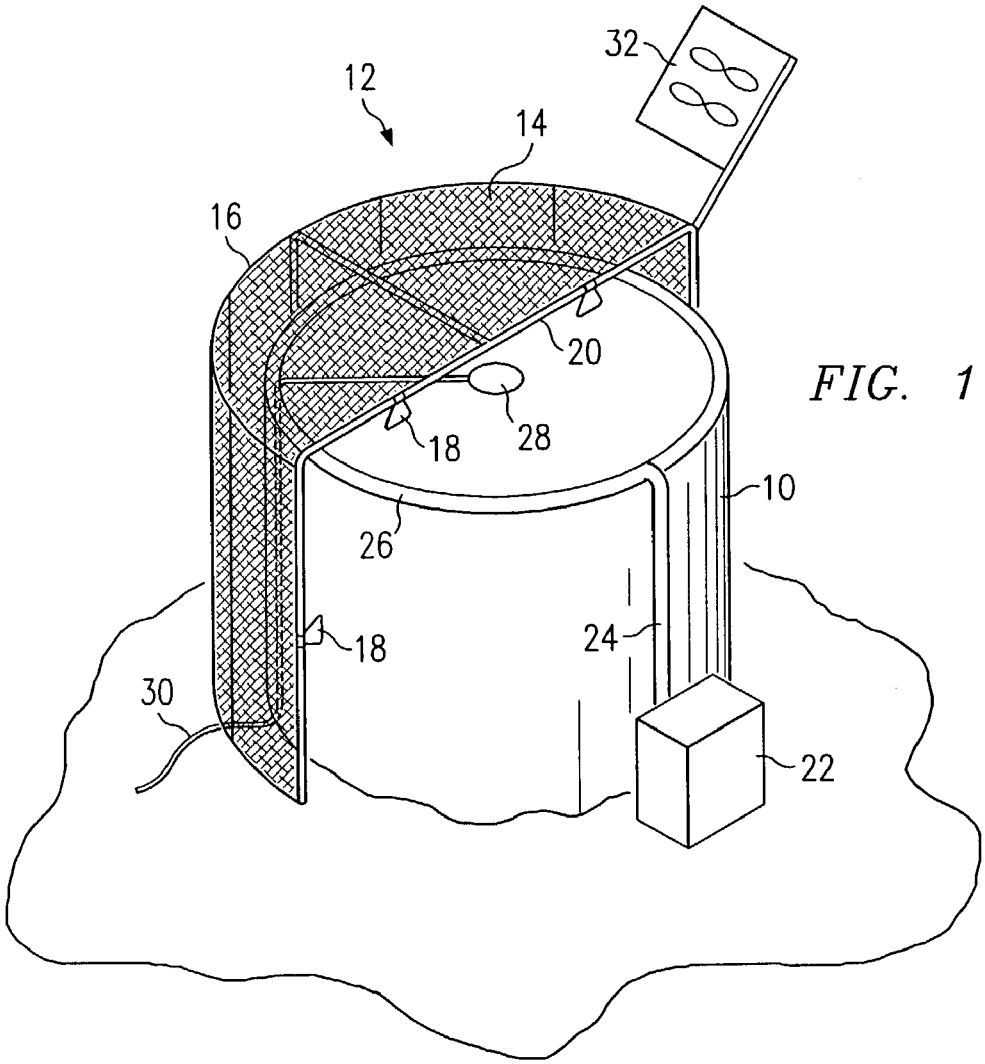
FIG. 1 illustrates a perspective view of a storage tank with a shade assembly partially broken-away according to the teachings of the present invention.

Referring to FIG. 1, a shade assembly 12 is installed in an operative position around a storage tank 10. The shade assembly includes a scaffold 16 to which shade panels 14 are attached. A sensor 28 detects one or more characteristics of the environment surrounding the tank or shade assembly and provides information detected to controller 30 which is powered by solar panel 32. When environmental conditions meet preset criteria, the controller 30 causes water pump 22 to disperse water through the water distribution system 20 to spray nozzles 18. Spray nozzles 18 dispense water into the area between the shade assembly 12 and the storage tank 10 or substantially onto the shade panels. Water is collected in gutter 26 and flows through drain pipe 24 to water pump 22 or to a water storage tank or cistern (not explicitly shown) operably connected to water pump 22 so as to provide water pump 22 with water.

Figure 2:
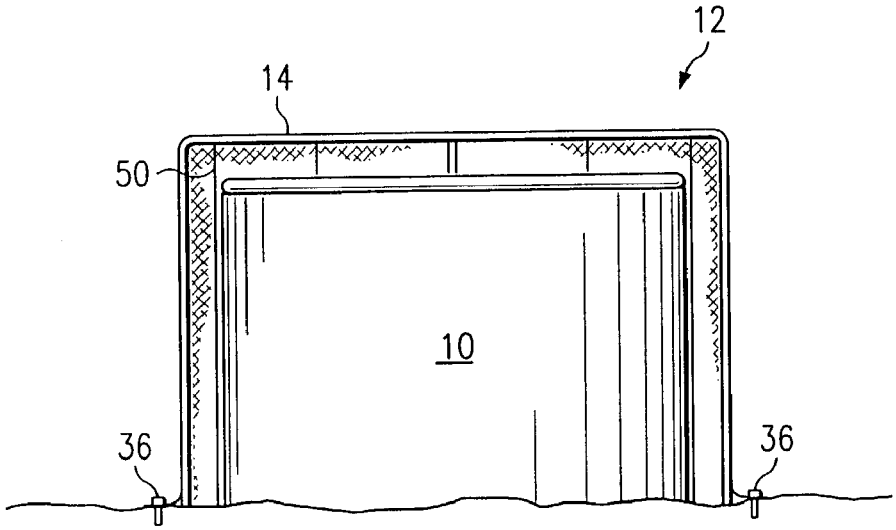
FIG. 2 illustrates a perspective view of a storage tank with another embodiment of a shade assembly partially broken away according to the teachings of the present invention.

Referring to FIG. 2, a shade assembly 12 is installed in an operative position around a storage tank 10. The shade assembly includes a scaffold 50 which rests upon the top or rim of storage tank 10 and to which shade panels 14 are attached. Shade panels 14 attached to the edge of scaffold 50 are additionally attached to ground anchors 36.

Figure 3:
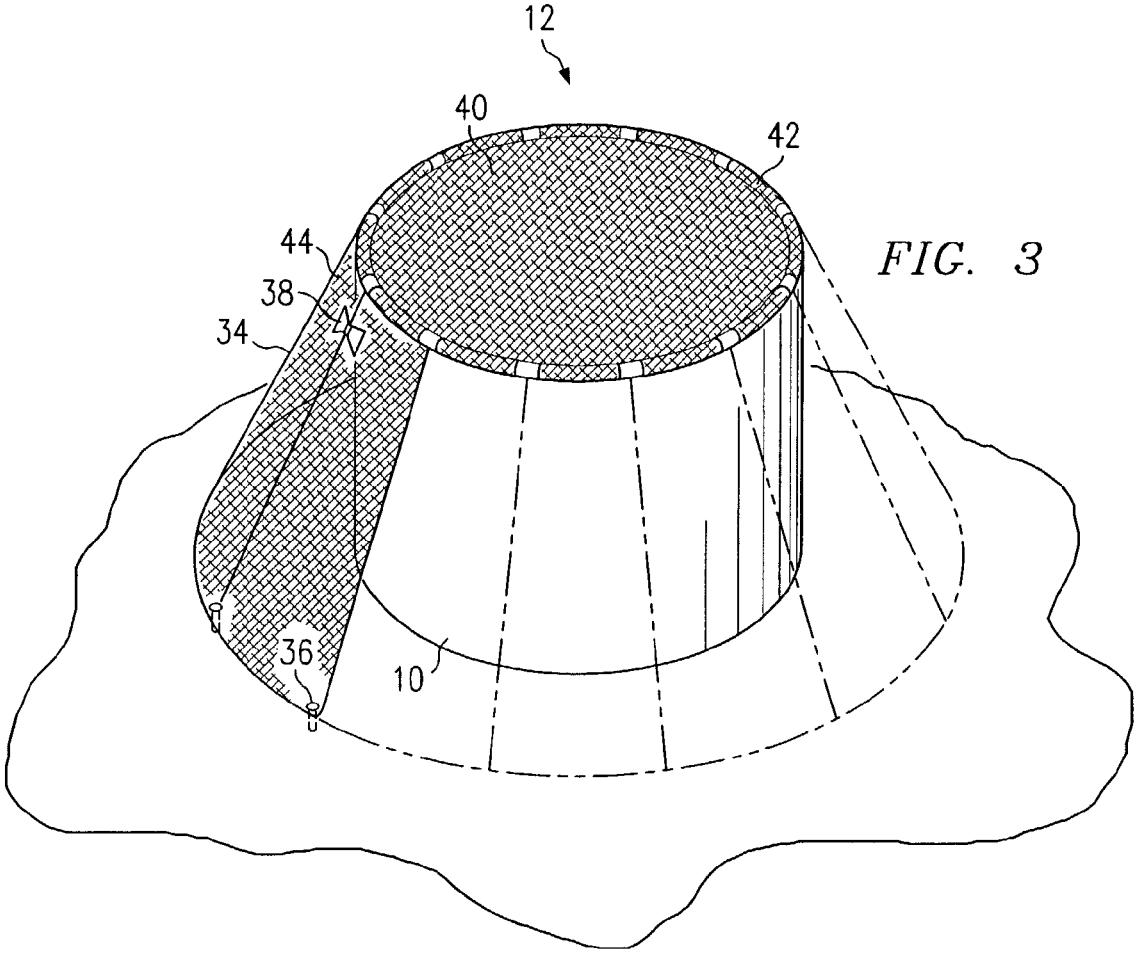
FIG. 3 illustrates a perspective view of a storage tank with another embodiment of a shade assembly partially broken-away according to the teachings of the present invention.

Referring to FIG. 3, a shade assembly 12 is installed in an operative position around a storage tank 10. Cables 34 are attached to the top rim of the tank 10 and extend to ground anchors 36 below at an angle. Reflective side shade panels 44 are attached to the cables 34 with fasteners 38. Reflective top shade panels 40 are attached to blocks 42 to form a top assembly which rests in an operative position on the top of the storage tank.

Figure 4:
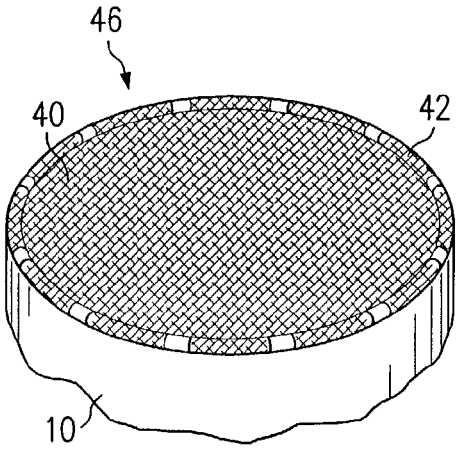
FIG. 4 illustrates a partially broken-away perspective view of a storage tank with another embodiment of a shade assembly not including side portions of the assembly according to the teachings of the present invention.

Referring to FIG. 4, blocks 42 rest near the outer rim of storage tank 10. Top reflective shade panels 40 are attached to blocks 42 in an operative position above the top of the storage tank.

Figure 5:
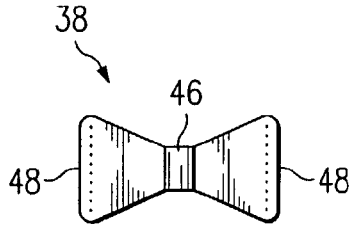
FIG. 5 illustrates a perspective view of a fabric fastener according to teachings of the present invention.

Referring to FIG. 5, a fabric fastener 38, in the unclosed position includes a central raised area 46 through which the cable may pass when two flaps 48 which are brought into proximity around the fabric of a shade panel when the fastener is closed.

The shade panels used in the embodiment of FIGS. 1 and 2 may be reflective/white, non-reflective/dark or any other hue. In an exemplary embodiment they are dark water-absorbent fabric. The panels used in the embodiment of FIGS. 3 and 4 are reflective and/or infrared emissive in certain embodiments.

Reflective shade panels may be white, silver, beige or any similar hue which has a good-to-high level of reflectivity of the sun's light or heat. The panels may generally be chosen by testing of the reflective shade material for degree of reflectivity and emissivity in the same manner that testing is done to establish effectiveness of the white or "cool" roof coating products.

Panels may also be chosen based upon manufacturer technical data such as shade factor (or transmissivity level of the material), puncture resistance, tear strength, burst strength, UV resistance and other desirable qualities. Alternatively, some work has been commissioned by the American Society of Agricultural Engineers that involved comparative testing of shade panel materials used to create a favorable growing environment for plants. One such study is provided in Willis, D. H., "Effect of Cloth Characteristics on Misted Shade Cooling Performance", Am. Soc. of Ag. Engs., Chicago, Ill., Jun. 18-23, 1995, provided as Attachment A. That study demonstrates that each of the types of fabric evaluated performed slightly differently depending upon color, thickness, construction method, and whether misted or not.

Although fabric shade panels are used in some embodiments of the invention, other types of materials may be used within the scope of the invention such as non-woven or non-fabric materials. Fabric panels, however, may be knitted or woven, reflective or dark, and may have various manufacturer shade factor ratings. Reflective shade panels may be made of vinyl-coated polyester, for example as sold under the trademarks SunTex 80 or SunTex 90 by Phifer Wire Products, Inc in "Stucco" color.

Dark shade panels may be black, dark grey, dark brown or any other hue that has a low reflectivity of the sun's light or heat. They may be water absorbent fabric. In an exemplary embodiment, the dark shades are rectangular and are constructed of polypropylene shade fabric, for example as sold under trademark NICO-SHADE by T C Baycor Corporation. For an 80% shade factor, the shade fabric has a weight of 3.7 ounces/square yard, an air porosity of about 700 cfm, with the polypropylene yarn having an oval warp and a round fill. In another exemplary embodiment, the dark shades are rectangular and are constructed of vinyl-coated polyester, for example as sold under the trademarks SunTex 80 or SunTex 90 by Phifer Wire Products, Inc in black, grey or brown color.

The scaffold 16 may be constructed in any manner sized to fit around the storage tank 10. In an exemplary embodiment it is spaced approximately one to six feet above the top of the tank and one to six feet from the sides of the tank. The scaffold 16 may have doors or removable panels for tank access. The entire assembly or removable panels may also be designed to allow removal during colder weather when solar heating of the storage tank may be desirable. The shade panels in this and other embodiments may be attached to the scaffold 16 (or, in FIG. 2, scaffold 50) using any type of retention mechanism, including hooks, clips, ties, UV treated rope and adhesives. Suitable fasteners also include those manufactured or sold by Pak-Unlimited. Fasteners may be designed to automatically release the shade panels when sufficient force is applied. This may, for instance, allow break-away if heavy snow, ice, or rain collects on the panels.

In the embodiment of FIG. 2, the scaffold 50 is spaced one to six feet above the top of the storage tank. The side shade panels are spaced one to six feet away from the sides of the tank. The lower ends of the side shade panels may be attached to ground anchors 36 in any appropriate manner or they may also be left unattached. Appropriate anchors for use in this and other embodiments also include those sold by Pak-Unlimited.

The water pump 22 may be of any sort that provides adequate pressure to ultimately dispense water mist through spray nozzles 18 at a suitable pressure. In an exemplary embodiment, the pump provides approximately 40 pounds of water pressure. Water for the pump may be collected in gutter 26 and fed through drain pipe 24 to pump 22 which may also contain a cistern. Water may also come from other sources, such as a central or commercial water supply. The presence and size of a cistern in or operably connected to pump 22 may be determined by the water source and, if the primary water source is collection of rainwater in gutter 26, by the climate of the region. Although one embodiment of a water recovery system is described herein, any water recovery system capable of collecting water dispensed within the shade assembly and/or rainwater may be operably connected to pump 22 to provide water. For instance, a large water recovery tank might be employed to collect rainwater then connected to several storage tanks covered with the shade system of the present invention.

Controller 30 is powered by a solar panel 32 in the embodiment of FIG. 1. Solar panel 32 may also be used to power water pump 22. Other power sources, such as a small wind generator, a battery or a connection to a power grid may also be used. Controller 30 may be any electronic, programmable controller and/or a computer-controlled management program. Controller 30 may also be a manual switch mechanism which may control one or multiple shade assemblies. Such an switch, for instance, might be manually activated by an operator on particularly hot days or during particularly hot times of day.

Spray nozzles 18 may be any type of mister, spray nozzle, or other apparatus through which water may pass. In an exemplary embodiment, the water is dispensed substantially in the direction of or within a short distance of the shade panels. Additionally, mister fan systems such as those sold by ThermalDyn may be used.

Referring to the embodiment of FIG. 3, the reflective side shade panels 44 may be attached to cables 34 with fasteners 38 or with any suitable type of fastener or retention mechanism such as clamps, ties, hooks, UV treated rope or adhesives. Shade panels may also be fabricated to snap, zip or lace together if it is cost-effective and desirable to do so. Cables 34 may be anchored to the rim or upper region of the tank in any manner, whether permanent or temporary. In the embodiment of FIG. 3, cables 34 are also attached to ground anchors 36 which may be of any appropriate form, including blocks and stakes. In this embodiment, cables 34 may be unattached from the ground anchors to allow access to the tank or to allow them to be rolled up during cooler weather when warming of the tank may be desirable. Although cables 34 are represented as extending from the top of tank 10 at an angle to lessen their contact with the side of tank 10 and thereby lessen heat transfer to tank 10, they may also lie substantially parallel to the side of tank 10.

Referring to FIGS. 3 and 4, top shade panels 40 are attached to strong yet lightweight blocks 42 of heat insulating material. Cables 34 and scaffolding 16 may be used as necessary to facilitate attachment of panels 40 to blocks 42 and to prevent or minimize contact of the panels with the top of the tank which would result in heat transfer to tank 10. The top assembly 46 may include openings, panels or flaps to allow access to specific areas of the top of the storage tank 46. All scaffold/framework, panels, blocks, cabling and water misting equipment, if utilized, may be chosen to enhance ease of operation, access, and especially safety.

Storage 10 in FIGS. 3 and 4 may be a floating top storage tank. In such a case the separation of reflective side shade panels 44 from reflective top shade panels 40 allows top assembly 46 to continue to rest on the top of storage tank 10 as the top descends into the tank. Further, top shade panels may include small openings, as may be required, to accommodate any guide poles. Misters or other water sources (not shown) may also be placed around the top rim of the tank and may be controlled so as to allow dispensation of water mist to cool the exposed interior sides of the tank as the floating top descends. Reflection of solar radiation by top assembly 46 might otherwise result in heating of the exposed interior sides of storage tank 10. Such heat would be transferred through the sides to the remaining tank contents. Alternatively, where the present invention is used on an external floating roof tank, the top shade panel(s) may remain fixed in place, either with or without mist being applied, rather than descending or rising as the level of the tank contents fall or rise. In some instances, and where water is plentiful, it may be advisable for the top of such a tank, or even that of an internal floating roof or dome-roofed tank, to have the top portion misted only, with the shade panels covering only the sides of the tank. Much flexibility can be exercised in designing the present invention to be complimentary with these or other storage tanks.

The above embodiments represent examples of a shade assembly for a storage tank, but do not include every contemplated embodiment of the present invention. It would be readily apparent to one skilled in the art based upon the above disclosure that the invention also encompasses the use of any covering which prevents or deters the absorption of solar radiation by a storage tank, especially a petrochemical storage tank.

Furthermore, although only embodiments of the invention for fixed storage tanks are shown, the invention additionally encompasses the covering of movable storage tanks to prevent or deter absorption of solar radiation. For instance, a scaffold and cable assembly with firmly secured reflective shade panels might be placed around all or part of a storage tank located on a truck or train car. Such an assembly might additionally be equipped with a mister system for use when the vehicle is stationery. The invention also includes a shade panel assembly for use on ship-board storage tanks. Such tanks may be on the deck of the vessel or may be located within its hull. Tanks on the deck of a vessel may be covered in a manner similar to stationery tanks on land or customized as needed. Interior tanks may be covered by placing a shade assembly on the deck over the area of the tanks and utilized either with or without water mist.

All or part of the assembly may be designed so that it may be collapsed to lay flat on the tank to allow access, prevent breakage under heavy weight, or for other reasons. In one embodiment, the collapsible assembly may be supported by deflatible air bags. Anchors and/or upright support posts may also be designed to allow collapse. Preferably the collapse mechanism will be easily reversible to the uncollapsed position. Support framework and/or block-type materials may be made from recycled materials such as recycled rubber or plastics. Shade panels may be made from a variety of knitted, woven or nonwoven materials and may be installed over and around storage tank in more than one layer, either in contact with one another or separated by a layer of air, in order to achieve the desired level of cooling most beneficial to the tank and its contents. Shade panels may be horizontally extended to adjacent areas of the storage tank, within reasonable distance, either with or without water mist being applied, to allow additional cooling benefits to not only the tank but to maintenance workers and employees who are working on the tank or in the vicinity of the tank. Extending the shaded area, in some very hot locations, will be beneficial in helping to cool the tank since a broader area of shade creates a lower ambient temperature in the vicinity of the tank. Shade panels that extend to adjacent areas may consist of reflective or dark panels of varying shade factors/transmissivity levels depending upon the amount of direct sunlight it is desirable to block and the ambient temperature it is best to maintain in regard to the contents of the particular tank or tanks being covered. In these adjacent areas, near a shaded tank and within an extended shade cover assembly, portable or stationary misting fans may be used, such as the WayCool or VersaFog products described in American Industrial Magazine, volume 3, issue 2, page 20, or the ThermaDyn systems.

In other embodiments of the present invention, the shade panels may be designed to track the sun's movement. This may allow use of fewer panels or scaffolding. Such tracking may be controlled in a variety of ways, including mechanisms using light or heat sensors or timing devices.

All embodiments of the present invention, when employed on petrochemical storage tanks, reduce the level of direct emissions from such tanks which result from solar heating and subsequent vaporization of the tank's contents. Environmental incentives, such as air quality credits may be obtained for certain emissions reductions. Thus the invention also includes a method by which emissions may be avoided or reduced allowing such air quality or pollution prevention credits, incentives or rebates to be obtained.

The present invention may also be useful in environmental non-attainment areas and heat islands by helping to alleviate these problems.

Although only exemplary embodiments of the invention are specifically described above, it will be appreciated that modifications and variations of the invention are possible without departing from the spirit and intended scope of the invention.

What is claimed is:

1. A shade assembly in combination with an aboveground storage tank extending from the ground, the storage tank having a top, a bottom, and a side, the shade assembly comprising:

a support mechanism connected to at least a portion of the storage tank; and an array of reflective or infrared emissive shade panels fastened to the support mechanism such that the shade panels are positioned to shade at least a portion of the storage tank from solar radiation so as to reduce solar heating of the storage tank and thereby reduce evaporation of the contents of the storage tank, wherein the support mechanism comprises an array of blocks fabricated of heat insulating material and securely attached to the top of the storage tank.

2. The assembly of claim 1, wherein the support mechanism further comprises a cable support mechanism.

3. The assembly of claim 2, wherein the cable support mechanism comprises a plurality of cables having one end attached at or near the top of the storage tank and another end attached to the ground.

4. The assembly of claim 1, wherein the blocks are attached to a top rim of the storage tank.

5. The assembly of claim 1, wherein the shade panels are porous.

6. The assembly of claim 5, wherein the shade panels are flexible.

7. The assembly of claim 1, wherein the shade panels are flexible.

8. The assembly of claim 1, wherein the shade panels define an opening to allow access to the storage tank.

9. The assembly of claim 1, wherein the shade assembly is detachable or removable from the storage tank.

10. The assembly of claim 1, wherein storage tank and the shade assembly are movable.

11. A shade assembly in combination with an aboveground storage tank extending from the ground, the storage tank having a top, a bottom and a side, the shade assembly comprising:

a support mechanism connected to at least a portion of the storage tank; and an array of dark or heat-absorbent shade panels fastened to the support mechanism such that the shade panels are positioned to shade at least a portion of the storage tank from solar radiation so as to reduce solar heating of the storage tank and thereby reduce evaporation of the contents of the storage tank, wherein the supnort mechanism comprises an array of blocks fabricated of heat insulating material and securely attached to the top of the storage tank.

12. The assembly of claim 11, wherein the support mechanism further comprises a cable support mechanism.

13. The assembly of claim 12, wherein the cable support mechanism comprises a plurality of cables having one end attached at or near the top of the storage tank and another end attached to the ground.

14. The assembly of claim 11, wherein the blocks are attached to a top rim of the storage tank.

15. The assembly of claim 11, wherein the shade panels are porous.

16. The assembly of claim 11, wherein the shade panels are flexible.

17. The assembly of claim 11, wherein the shade panels define an opening to allow access to the storage tank.

18. The assembly of claim 11, wherein storage tank and the shade assembly are movable.

19. The assembly of claim 11, wherein the shade panels are spaced between one and six feet from the storage tank.

20. A shade assembly in combination with an above-ground storage tank extending from the ground, the storage tank having a top, a bottom and a side, the shade assembly comprising:

at least one porous, flexible shade panel supported in a spaced relationship to the storage tank such that the shade panel is positioned to shade at least a portion of the storage tank from solar radiation so as to reduce solar heating of the storage tank and thereby reduce evaporation of the contents of the storage tank, wherein the shade panel is supported in a spaced relationship to the storage tank by a support mechanism connected to a portion of the storage tank, and wherein the support mechanism comprises a plurality of blocks fabricated of heat insulating material and attached to the top of the storage tank.

21. The assembly of claim 20 wherein the shade panel is positioned to shade the top of the storage tank and at least a portion of the side of the storage tank.

22. The assembly of claim 20 wherein the support mechanism further comprises a cable support mechanism.

23. The assembly of claim 22 wherein the cable support mechanism comprises a plurality of cables having one end attached at or near the top of the storage tank and another end attached to the ground.

24. The assembly of claim 20, wherein the blocks are attached to a top rim of the storage tank.

* * * * *

UNITED STATES PATENT AND TRADEMARK OFFICE

CERTIFICATE OF CORRECTION

PATENT NO. : 7,246,468 B2
APPLICATION NO. : 10/394129
DATED : July 24, 2007
INVENTOR(S) : Jack R. Forbis, Sr.

It is certified that error appears in the above-identified patent and that said Letters Patent is hereby corrected as shown below:

Column 9, line 9: Delete “supnort” and replace with -- support --.

Signed and Sealed this

Eighteenth Day of September, 2007

JON W. DUDAS
*Director of the United States Patent and Trademark Office*